US005686927A

United States Patent [19]

Simmons

[11] Patent Number: 5,686,927

[45] Date of Patent: Nov. 11, 1997

[54] RETRACTABLE ANTENNA

[75] Inventor: Kenneth D. Simmons, Lincoln, Nebr.

[73] Assignee: Centurion International, Inc., Lincoln, Nebr.

[21] Appl. No.: 552,887

[22] Filed: Nov. 3, 1995

[51] Int. Cl.[6] ..... H01Q 1/24

[52] U.S. Cl. ..... 343/702; 343/895; 343/850

[58] Field of Search ..... 343/702, 895, 343/850, 900, 901, 860; H01Q 1/24

[56] References Cited

U.S. PATENT DOCUMENTS

| | | | |
|---|---|---|---|
| 4,205,319 | 5/1980 | Gasparaitis et al. | 343/792 |
| 4,760,401 | 7/1988 | Imazeki | 343/702 |
| 4,849,767 | 7/1989 | Naitou | 343/745 |
| 4,867,698 | 9/1989 | Griffiths | 439/317 |
| 5,079,558 | 1/1992 | Koike | 343/702 |
| 5,177,492 | 1/1993 | Tomura et al. | 343/702 |
| 5,204,687 | 4/1993 | Elliott et al. | 343/702 |
| 5,300,940 | 4/1994 | Simmons | 343/749 |
| 5,353,036 | 10/1994 | Baldry | 343/702 |
| 5,374,937 | 12/1994 | Tsunekawa et al. | 343/895 |

FOREIGN PATENT DOCUMENTS

| | | | |
|---|---|---|---|
| 3245603 | 11/1991 | Japan . | |
| 6-85519 | 3/1994 | Japan | H01Q 1/24 |

OTHER PUBLICATIONS

Lightweight Trap Antennas—Some Thoughts Jun. 1983.

*Primary Examiner*—Hoanganh T. Le

*Attorney, Agent, or Firm*—Zarley, McKee, Thomte, Voorhees & Sease; Dennis L. Thomte

[57] ABSTRACT

A retractable antenna for use with a communications device such as a cellular telephone is described and which may be moved from a fully extended position to a fully retracted position with respect to the telephone housing. The telephone circuitry utilizes a matching circuit to match a high impedance when the antenna is in the extended position. When the antenna is in the retracted position, it changes from a series resonance circuit to a parallel resonance circuit so that it may match the low impedance.

2 Claims, 2 Drawing Sheets

RETRACTABLE ANTENNA

BACKGROUND OF THE INVENTION

1. Field of the Invention

The present invention relates to portable communication equipment that utilize retractable antennas. More particularly, the present invention relates to antennas for portable communication equipment that provide performance for the selected mode, retracted or extended.

2. Description of the Related Art

There are at least six related designs commonly used in the field of retractable antennas. Perhaps the simplest design is the fixed length linear whip radiator that has an electrical contact on the one end, which makes contact with an electrical connector when the radiator is pulled out of the electronic device. In such a design, retraction of the radiator is accomplished by pushing the whip radiator downwardly from its connection with the connector and into the electronic device.

A further design in the prior art is the telescopic whip that is used for portable consumer products. The telescopic whip generally consists of progressively smaller diameter tubes that fit within the next tube. Such a technique permits the antenna to be collapsed or retracted to a length only slightly longer than the largest diameter tube.

U.S. Pat. No. 4,868,576 discloses a third type of design that consists of a linear whip radiator that is air-coupled to a monofilar helical matching device in the extended position. In the retracted mode, the monofilar matching helical device is used as the electromagnetic radiator.

U.S. Pat. No. 5,204,687 discloses yet another type of retractable antenna. U.S. Pat. No. 5,204,687 describes the retractable antenna as being a ¼ wavelength retractable antenna that consists of a thin linear radiator having an isolated, short monofilar helical radiator on the end. In the extended mode of operation, the thin linear radiator functions as a whip radiator having approximately a ¼ wavelength electrical length. The helical radiator section is positioned on the upper end of the linear radiator and is isolated therefrom by a short section of dielectric preventing the helical radiator from being in the electrical circuit when the antenna is extended. When the antenna is in the retracted mode, the helical radiator is in the electrical circuit due to the retraction of the linear radiator into the electronic device with the helical radiator's electrical connection being made by a short metal tube below the helical radiator.

Yet another type of retractable antenna is that manufactured by Centurion International, Inc. of Lincoln, Nebr., that consists of a ½ wavelength thin linear radiator with a short monofilar helical radiator connected to the end. In either mode of operation, retracted and extended, the entire antenna package is in the electrical circuit.

SUMMARY OF THE INVENTION

A retractable antenna for a portable communication device such as a cellular telephone, two-way radio, etc., is provided which offers maximum performance in the selected mode of operation, retracted or extended. The maximum performance is accomplished by an integrated matching circuit within the communication device which has two contact positions. One contact position is for series matching of a high impedance load, i.e., the whip in the extended mode. In the retracted mode, both contacts serve to modify the circuit so that it is a parallel resonance circuit to match a lower impedance than the extended antenna. This provides proper impedance match in both positions, thereby minimizing mismatch losses in either case.

It is therefore a principal object of the invention to provide an improved antenna.

Another object of the invention is to provide a retractable antenna which offers maximum performance in the selected mode of operation, retracted or extended.

Yet another object of the invention is to provide a retractable antenna which offers maximum performance in the selected mode of operation, retracted or extended, which is accomplished by an integrated matching circuit within the communication device providing two contact positions.

Yet another object of the invention is to provide a matching circuit described above wherein in the retracted mode, both contacts serve to modify the circuit so that it is a parallel resonance circuit to match a lower impedance than the extended antenna.

Yet another object of the invention is to provide a retractable antenna which has a proper impedance match in either the extended or retracted positions.

These and other objects will be apparent to those skilled in the art.

DESCRIPTION OF THE PREFERRED EMBODIMENT

Figure 1:
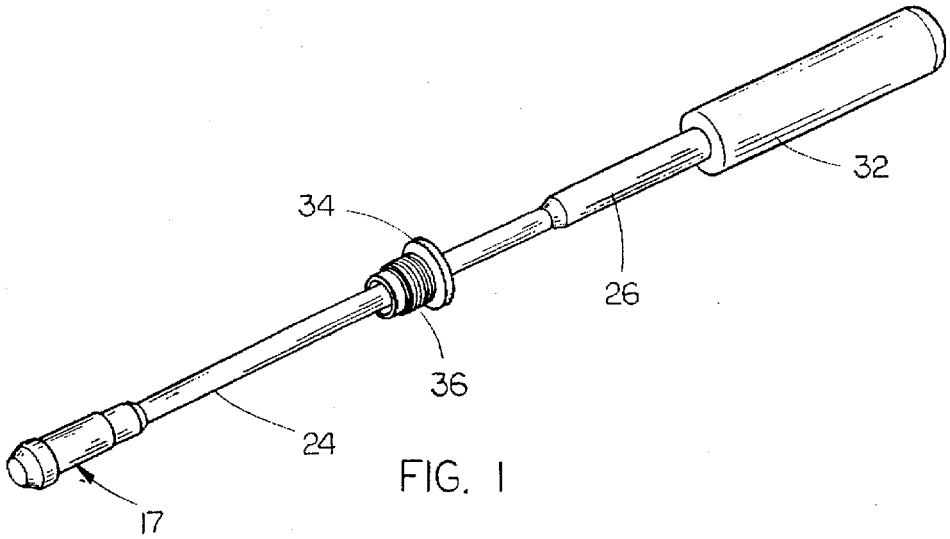
FIG. 1 is a perspective view of the antenna of this invention.
Figure 2:
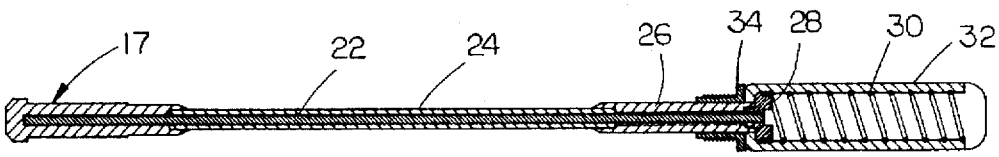
FIG. 2 is a longitudinal cross-sectional view of the antenna of FIG. 1.
Figure 3:
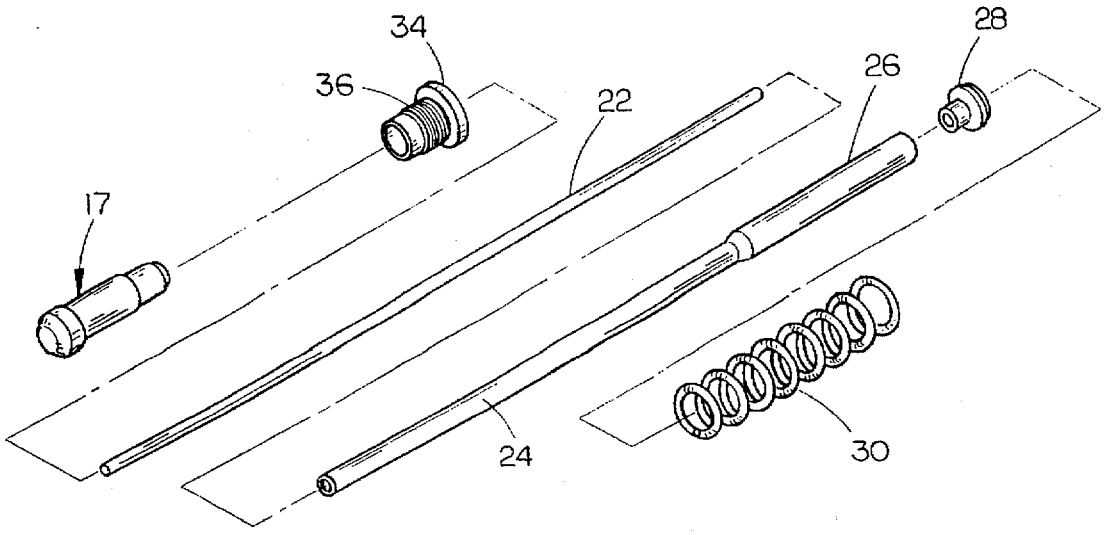
FIG. 3 is an exploded perspective view of the antenna of FIG. 1.

The antenna of this invention is referred to generally by the reference numeral 10 and is designed to be used with portable communication equipment utilizing retractable antennas. More particularly, the antenna 10 is designed to be used with a cellular telephone which would include the conventional internal telephone circuitry The only modification to the conventional telephone circuitry is the utilization of a matching circuit referred to generally by the reference numeral 12 and which includes a pair of spring contacts 14 and 16 as will be described in more detail hereinafter.

Antenna 10 includes a lower metallic connector 17 which provides the electrical path from the communication device into the whip antenna in the extended position as will be described in more detail hereinafter. Connector 17 includes a stop 18 and a bore 20 formed therein.

Figure 4:
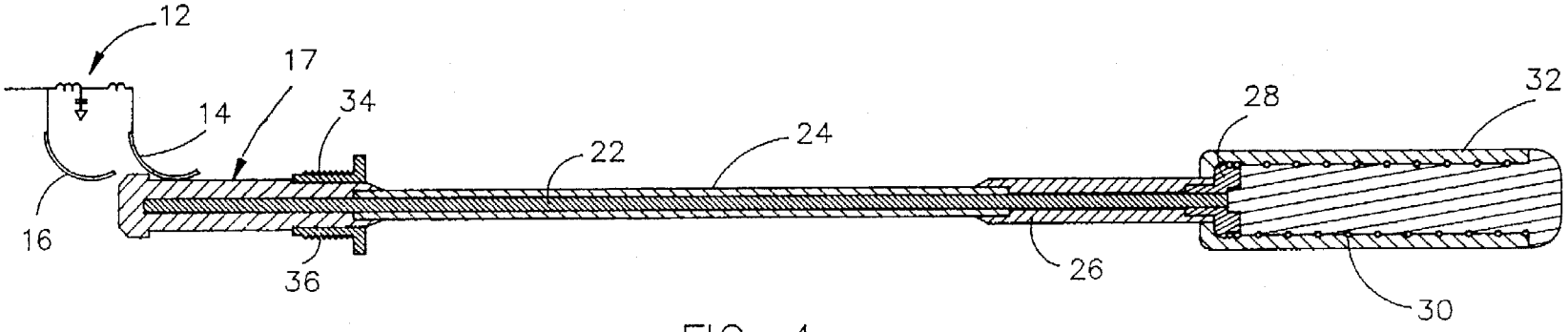
FIG. 4 is a longitudinal sectional view of the antenna illustrating both of the contacts of the matching circuit of the telephone circuit being in RF engagement with the connector at the lower end of the antenna.
Figure 5:
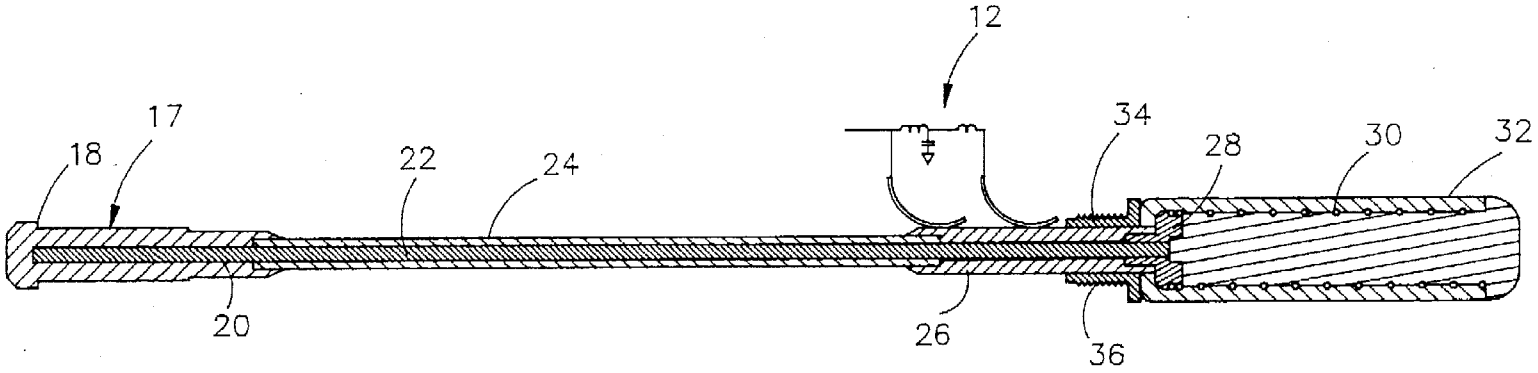
FIG. 5 is a view similar to FIG. 4 except the antenna has been moved to its fully retracted position.

The numeral 22 refers to the metallic whip section or radiator which is RF connected to the metallic connector 17, as illustrated in FIG. 5, in conventional fashion. Radiator 22 is enclosed by a sheath of dielectric material referred to generally by the reference numeral 24. Metallic sleeve 26 is RF connected to the upper end of the radiator 22 and has a head portion 28 provided at the upper end thereof. If desired, head portion 28 may be in the form of a separate bushing which is secured to the upper end of the sleeve 26. The numeral 30 refers to a monofilar helical radiator which is RF connected to the head portion 28, as seen in FIGS. 4 and 5. Helical radiator 30 is enclosed by dielectric overmold or coating 32 in conventional fashion. Slidable connector 34 is provided and has external threads 36 adapted to be threaded into the conventional receptacle at the upper end of the communications device and which is RF connected to the telephone circuitry of the communications device in conventional fashion.

When the antenna is in its fully extended position, such as illustrated in FIG. 4, only contact 14 is in electrical contact with the connector 17. When the antenna is moved to its fully retracted position, such as illustrated in FIG. 5, both of the contacts 14 and 16 engage the sleeve 26. In some instances, contact 14 could engage connector 34 if desired.

In operation, the antenna 10 works in conjunction with the matching circuit 12. In the extended mode, antenna 10 utilizes a T-type matching circuit to match the feed impedance of the antenna. In the retracted mode, the matching circuit transfers from a series resonance circuit to a parallel resonance circuit which is still active in the circuit. As stated, there are two contacts in the matching circuit, namely contacts 14 and 16, one on the high impedance side and one on the low impedance side. When the low and high impedance sides are in the retracted mode, both are in contact with the antenna through the sleeve 26. Matching of the lower impedance is not quite 50 ohms. The antenna illustrated in the drawings is utilized as a ½ wave application, but it may be of any length. As stated, the matching circuit within the communication device will match a high impedance when the antenna is in the extended position. When the antenna is in the retracted position, it will change from a series resonance circuit to a parallel resonance circuit so that it may match the low impedance.

The antenna of this invention does not have to be a ½ wave or a multiple ½ wave antenna. The antenna is driven by a design of the matching circuit and the values incorporated therein. When the antenna is extended, a high impedance point is reached when greater than a ¼ wave is used at which time the impedance point goes up. When the antenna is in the retracted position, an impedance point along the helical and the whip section of the antenna is achieved which is lower than the antenna in the extended position.

By utilizing the matching circuit in both the extended and retracted modes, it is now possible to obtain the best match obtainable to achieve matching performance of the antenna.

Thus it can be seen that the invention accomplishes at least all of its stated objectives.

I claim:

1. A retractable antenna for a cellular telephone including a housing having a receptacle at the upper end thereof which is RF coupled to the telephone circuitry and which has a bore formed therein, comprising:

a first metal connector having upper and lower ends;

an elongated cable antenna having upper and lower ends;

the lower end of said cable antenna being RF coupled to said first metal connector;

an elongated metal sleeve having upper and lower ends, said metal sleeve being RF coupled to the upper end of said cable antenna;

a helical antenna positioned at the upper end of said metal sleeve and being operatively RF coupled thereto;

an insulating cap means enclosing said helical antenna;

an insulating sheath means enclosing said cable antenna between said first metal connector and said metal sleeve;

a second metal connector for RF connection to said receptacle and having a bore extending therethrough, said second metal connector having lower and upper ends, said lower end of said second metal connector being received within said bore of said receptacle;

said cable antenna being slidably received within said bore of said second metal connector whereby said cable antenna is slidably movable, with respect to the telephone, from a fully retracted position to a fully extended position;

said helical antenna being RF coupled to said receptacle and the telephone circuitry, through said metal sleeve, when said cable antenna is in its fully retracted position;

said cable antenna and said helical antenna being RF coupled to said receptacle and the telephone circuitry, through said first metal connector, when said cable antenna is in its fully extended position;

said telephone circuitry including a single matching circuit having a first high impedance contact and a second low impedance contact;

said first metal connector being in RF engagement with said first high impedance contact when said cable antenna is in its said fully extended position;

said second metal connector being in operative RF engagement with said first high impedance contact and second low impedance contact when said cable antenna is in its said fully retracted position.

2. The retractable antenna of claim 1 wherein said single matching circuit comprises a series resonance circuit when said cable antenna is in its said fully extended position and comprises a parallel resonance circuit when said cable antenna is in its said fully retracted position.

* * * * *